US007008511B2

(12) United States Patent
Haase et al.

(10) Patent No.: US 7,008,511 B2
(45) Date of Patent: Mar. 7, 2006

(54) WIRE SECTION

(75) Inventors: Christoph Haase, Neulengbach (AT); Guenter Halmschlager, Krems (AT); Martin Vogt, Prinzersdorf (AT)

(73) Assignee: Voith Paper Patent GmbH, Heidenheim (DE)

( * ) Notice: Subject to any disclaimer, the term of this patent is extended or adjusted under 35 U.S.C. 154(b) by 79 days.

(21) Appl. No.: 10/316,489

(22) Filed: Dec. 11, 2002

(65) Prior Publication Data

US 2003/0106662 A1 Jun. 12, 2003

(30) Foreign Application Priority Data

Dec. 12, 2001 (DE) ..... 101 61 056

(51) Int. Cl.
*D21F 1/00* (2006.01)
*D21F 9/00* (2006.01)

(52) U.S. Cl. ..... 162/301; 162/300; 162/304; 162/351; 162/352; 162/363

(58) Field of Classification Search ..... 162/300, 162/301, 303, 304, 308, 351, 352, 363, 364, 162/123, 132, 133, 203, 217, 348
See application file for complete search history.

(56) References Cited

U.S. PATENT DOCUMENTS

| | | | | |
|---|---|---|---|---|
| 4,790,909 A | * | 12/1988 | Harwood | 162/301 |
| 4,925,531 A | | 5/1990 | Koski | 162/301 |
| 5,201,999 A | * | 4/1993 | Field et al. | 162/301 |
| 5,215,628 A | * | 6/1993 | Koivuranta et al. | 162/301 |
| 5,248,392 A | * | 9/1993 | Bando et al. | 162/301 |
| 5,387,320 A | | 2/1995 | Jaakkola | 162/203 |
| 5,500,091 A | * | 3/1996 | Buck et al. | 162/301 |
| 5,582,688 A | * | 12/1996 | Bando et al. | 162/301 |
| 5,788,816 A | * | 8/1998 | Steckenreuter et al. | 162/304 |
| 5,798,024 A | * | 8/1998 | Odell et al. | 162/203 |
| 5,972,168 A | | 10/1999 | Egelhof et al. | 162/304 |
| 6,132,559 A | * | 10/2000 | Haavanlammi et al. | 162/203 |
| 6,776,877 B1 | * | 8/2004 | Grabscheid et al. | 162/301 |

FOREIGN PATENT DOCUMENTS

| | | | |
|---|---|---|---|
| DE | 19651493 | 6/1998 | 11/4 |
| DE | 19803591 | 8/1999 | |
| DE | 19949354 | 4/2001 | 11/4 |
| EP | 0454989 | 11/1991 | |
| EP | 0894894 | 2/1999 | |

* cited by examiner

*Primary Examiner*—Eric Hug
(74) *Attorney, Agent, or Firm*—Taylor & Aust, P.C.

(57) ABSTRACT

A wire section in a machine for the production of a fiber web including at least one twin wire former including a revolving continuous inner wire and a revolving continuous outer wire that converge in the area of a forming roll. After the forming roll, viewed in the direction of web travel, and inside the loop of the inner wire and inside the loop of the outer wire at least one additional strip element is located.

13 Claims, 2 Drawing Sheets

WIRE SECTION

BACKGROUND OF THE INVENTION

1. Field of the Invention

The present invention relates to a wire section in a machine for the production of a fiber web, and, more particularly, to a paper or cardboard web.

2. Description of the Related Art

Wire sections of conventional design are known from German patent documents DE 196 51 493 A1 and DE 198 03 591 A1, and from U.S. Pat. No. 4,925,531. Conventional dewatering element arrangements in such wire sections suffer from possible one-sided dewatering which can have the effect of "sheet sealing". What is needed in the art is a wire section with dewatering elements arranged in a manner that results in improved sheet formation.

SUMMARY OF THE INVENTION

The present invention provides a wire section that results in improved sheet formation.

The invention comprises, in one form thereof, a wire section in a machine for the production of a fiber web, specifically a paper or cardboard web, that is equipped with at least one twin wire former that comprises a revolving continuous inner wire and a revolving continuous outer wire that converge in the area of a first forming element which is in the embodiment of a forming roll; whereby after the first forming element inside the loop of the outer wire, as well as inside the loop of the inner wire at least one additional strip element is located respectively, viewed in direction of travel.

Preferably, at least one of the additionally provided strip elements is in the embodiment of a deflector. Such a deflector can specifically be provided in the form of a doctor element, preferably for water and/or in the form of a forming element for causing a pulsating action.

The wire section in accordance with the current invention also can include at least one of additional strip elements that comprise at least one suction element. For this purpose at least one of these additional strip elements may specifically be a suction box. Such a suction box can for example have an at least essentially flat surface. Basically however, a suction box having a curved surface is also feasible.

The suction element can preferably be supplied with a vacuum that increases with the direction of wire travel. If several suction elements are arranged in tandem, the suction elements can be supplied with vacuum that increases in direction of wire travel.

According to a suitable practical arrangement, at least one of the additionally provided strip elements is in the embodiment of a plate cover that is slotted transversely to the direction of wire travel.

According to another embodiment at least one of the additional strip elements is in the embodiment of a perforated and/or fishbone patterned and/or slotted plate cover.

In certain instances it could also be advantageous if at least one of the additionally provided strip elements comprises a combination of individual strips.

The additional strip elements can, for example, be located alternately inside the loop of the outer wire and inside the loop of the inner wire.

Specifically, an arrangement is also feasible in which the additional strip elements are located in pairs opposite each other, at least partially, whereby the one strip element of a respective strip element pair is located inside the loop of the outer wire and the other one is located inside the loop of the inner wire. In one arrangement at least one pair of strip elements, positioned opposite each other, offset in direction of wire travel, may be provided.

In certain instances it is also advantageous if at least a segment of the additional strip elements dips into the wires.

In a suitable practical arrangement the wires are guided over at least one of the additional strip elements.

The two wires can also be guided specifically over a turning roll.

The wire section may be configured for the formation of a single ply or the formation of a multi-ply fiber web.

In order to form a multi-ply fiber web a configuration is, for example, possible in which the fiber ply that is formed by the twin wire former is combined with a fiber ply that is delivered on a basic belt or similar device. For this purpose, the fiber plies may be combined specifically in the area of a couch roll. Such a couch roll would be located preferably inside the loop of the outer wire of the twin wire former.

After the twin wire zone the inner wire can, for example, be guided over a turning roll.

In a suitable practical arrangement of the wire section according to the current invention the first forming element is in the embodiment of a forming roll, having an outside diameter of approximately 1600 mm to 1900 mm.

The first forming element may or may not, be equipped with suction.

If the first forming element were indeed a forming roll, the angle of wrap at which the wires wrap around the forming roll would preferably be in a range of approximately 75° to approximately 110°.

Preferably, a second forming element, specifically an outer wire suction box is located on that side of the twin wire zone that is facing away from the first forming element, and/or is located on the same side.

The additional forming element may be cambered or have a convex progression. The additional forming element may however also be straight or have a straight progression.

It is also advantageous if, in the area of the additional forming element on the side of the twin wire zone facing away from the forming element at least one, preferably at least two strips press against the inner wire, or fit closely against it, at least during operation. Preferably at least one strip may be aligned in relation to the inner wire, preferably at least during operation, to be either resilient or fixed. The alignment may occur for example pneumatically, hydraulically, mechanically and/or electro-mechanically, whereby an adjustment is also fundamentally possible. It is preferable if at least one strip is fixed—in other words, not be adjustable during operation.

In another embodiment of the wire section according to the current invention, two strips are provided, located following each other viewed in direction of wire travel, whereby the first is adjustable toward the inner wire, and the second is fixed, or vice versa.

A first of the additional strip elements may specifically be located on the side of the twin wire zone facing the first forming element, whereby it is preferably offset relative to the additional forming element, viewed in direction of wire travel. Incidentally, specifically dewatering or forming elements can also be provided inside the loop of the inner wire and/or the loop of the outer wire in any desired combination.

It is advantageous if a second additional strip element is provided on the side of the twin wire zone facing the additional forming element, whereby it is preferably offset from the first strip element, viewed in direction of wire travel.

Additionally, configurations are also feasible where—viewed in direction of wire travel—following the first forming element or forming roll a strip element is provided on the inner wire, and offset on the opposite side of the twin wire zone a suction—equipped strip element is provided on the outer wire. Offset on the opposite side, on the inner wire, a suction—equipped strip element can again be provided. In such a configuration the elements would only dip marginally into the wire, so that the relevant S-shaped wire run as in the previously referred to known wire sections exists only in projections, or not at all.

An advantage of the present invention is a more uniform activation and dewatering of the fiber stock suspension on both sides, thereby providing an improved sheet formation and accordingly higher sheet quality

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
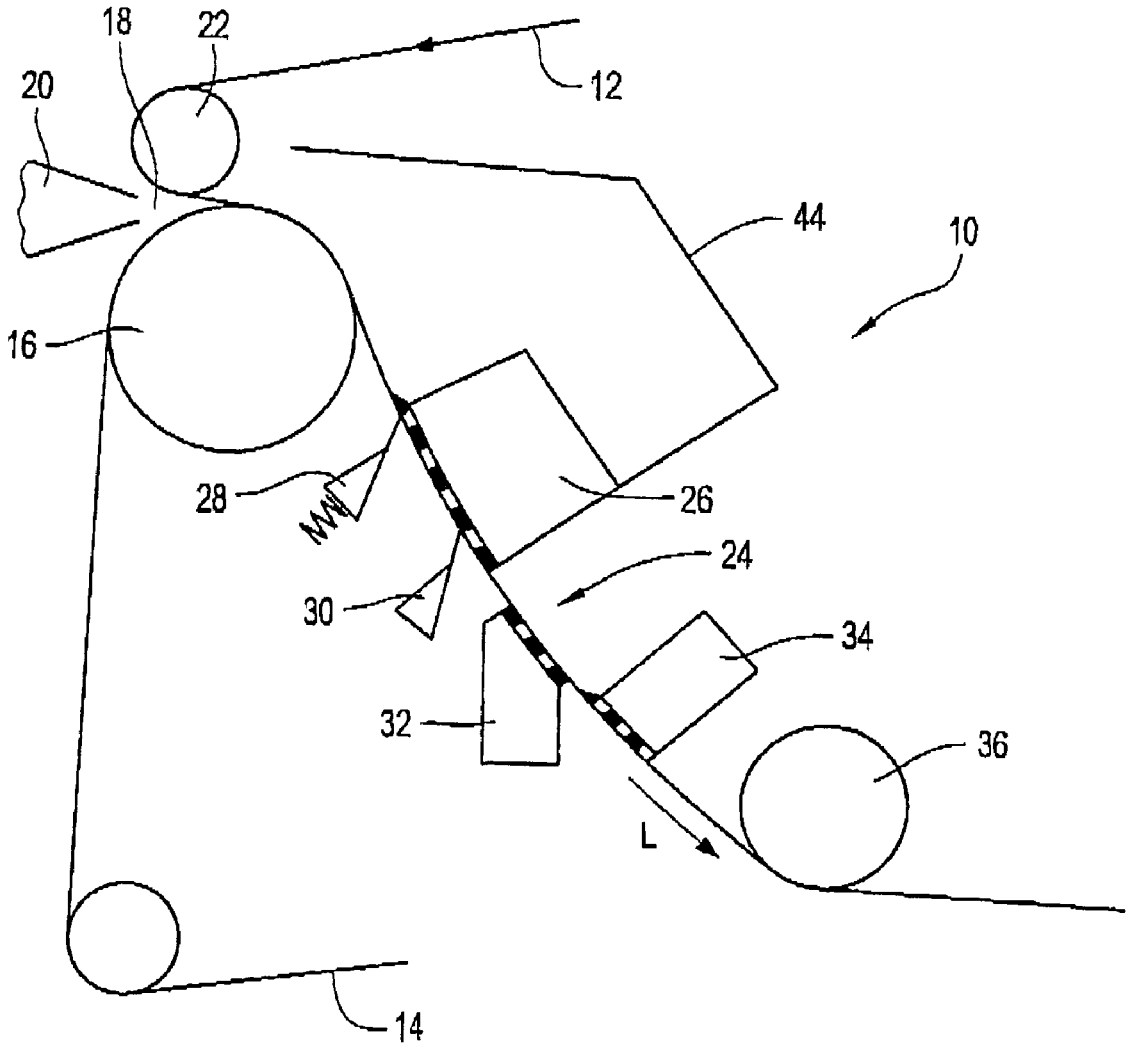
FIG. 1 is a schematic partial illustration of an embodiment of a wire section used in a twin wire former.

Referring now to the drawings, and more particularly to FIG. 1, there is shown an embodiment of a wire section in a machine for production of a fiber web according to the present invention which generally includes a twin wire former 10 consisting of a revolving continuous inner wire 14 and a revolving continuous outer wire 12 that converge in a suspension inlet opening in the area of a first forming element in the embodiment of a forming roll 16. The fiber suspension is supplied via a headbox 20 into the inlet opening 18.

In the area of the inlet opening 18 the outer wire 12 is run over a breast roll 22.

On the side of the twin wire zone 24 that is facing away from the forming roll 16, a forming element 26 is provided that may be in the embodiment of an outer wire suction box, or a similar device.

In the area of the forming element 26 two strips 28, 30 are pressed against the inner wire 14 on the side of the twin wire zone 24 that is facing away from the forming element 26.

At least one of the two strips 28, 30 can be adjusted toward the inner wire 14. In the existing example, when viewed in direction of wire travel L, the first strip 28 is adjustable and the second strip 30 is fixed. The adjustment of the appropriate strip can for example occur pneumatically.

At least one strip element 32, 34 is additionally provided after the forming roll 16 viewed in direction of wire travel L inside the loop of the inner wire 14, as well as inside the loop of the outer wire 12.

The additional strip elements 32, 34 may for example be in the embodiment of a deflector or a suction element, for example a suction box. The respective suction box may have an at least essentially flat surface, or a curved surface. A respective suction element may for example, be supplied with vacuum that is increasing in direction of wire travel.

The additionally provided strip elements 32, 34 may for example be a plate cover that is slotted transversely to the direction of wire travel, or a plate cover that is perforated or fishbone patterned. A combination of individual strips is for example, also possible.

The arrangement may be alternating and/or opposite each other, preferably offset. The elements would preferably dip into the wires. The wires may also be turned over the strip elements.

As can be seen from FIG. 1, the first strip element 32 in the existing sample is located inside the loop of the inner wire 14, after the forming element 26, viewed in direction of wire travel L. The second strip element 34 is located inside the loop of the outer wire 12, after the first strip element 32, viewed in direction of wire travel L. After the second strip element 34 the two wires 12, 14 are run over a turning roll 36.

The forming roll 16 may, for example, have an outside diameter of approximately 1760 mm.

At a machine speed in excess of approximately 800 m/min. the forming roll 16 may be supplied selectively with suction. At a machine speed in excess of approximately 1000 m/min. the forming roll 16 must be supplied with suction (for example 0.1 bar). The angle of wrap at which the two wires 12, 14 wrap around the forming roll 16 is preferably in a range of approximately 75° to approximately 110°.

The forming element 26 that is located on the opposite side of the twin wire zone 24 may for example be an outer wire suction box or a top wire suction box. A first section of this forming element 26 may for example comprise nine strips, and have a radius of approximately 2000 mm. A second section of this forming element 26 may for example comprise thirteen strips and have a radius for example, of approximately 5000 mm. A vacuum of 0.15 bar may, for example, be produced.

As already mentioned, the two strips 28, 30 may press onto the inner wire 14 in the area of this forming element 26. In the present example the first strip 28 viewed in direction of wire travel L may for example be adjusted pneumatically, while the second strip 30 is fixed.

As can be seen from FIG. 1, in the present example the first additionally provided strip element 32 is located on the side of the twin wire zone 24 that is facing the first forming element 16, whereby it is preferably offset relative to the additional forming element 26, viewed in direction of wire travel L.

The second additional strip element 34 is located in the present example on the side of the twin wire zone 24, facing the additional forming element 26, whereby it is offset relative to the first strip element 32, viewed in direction of wire travel L.

The first strip element 32 may, for example, have a radius of approximately 10000 mm and may be supplied with a vacuum at approximately 0.15 bar. The cover length may be approximately 400 mm.

As can be seen from FIG. 1, a wire water-collecting pan 44 may also be provided.

As already indicated, the stated values are to be considered merely as examples.

The second additionally provided strip element 34 may—for example—also have a radius of approximately 10000 mm, and may be supplied with a vacuum of approximately 0.15 bar. In this instance too, the cover length could for example be approximately 400 mm.

Figure 2:
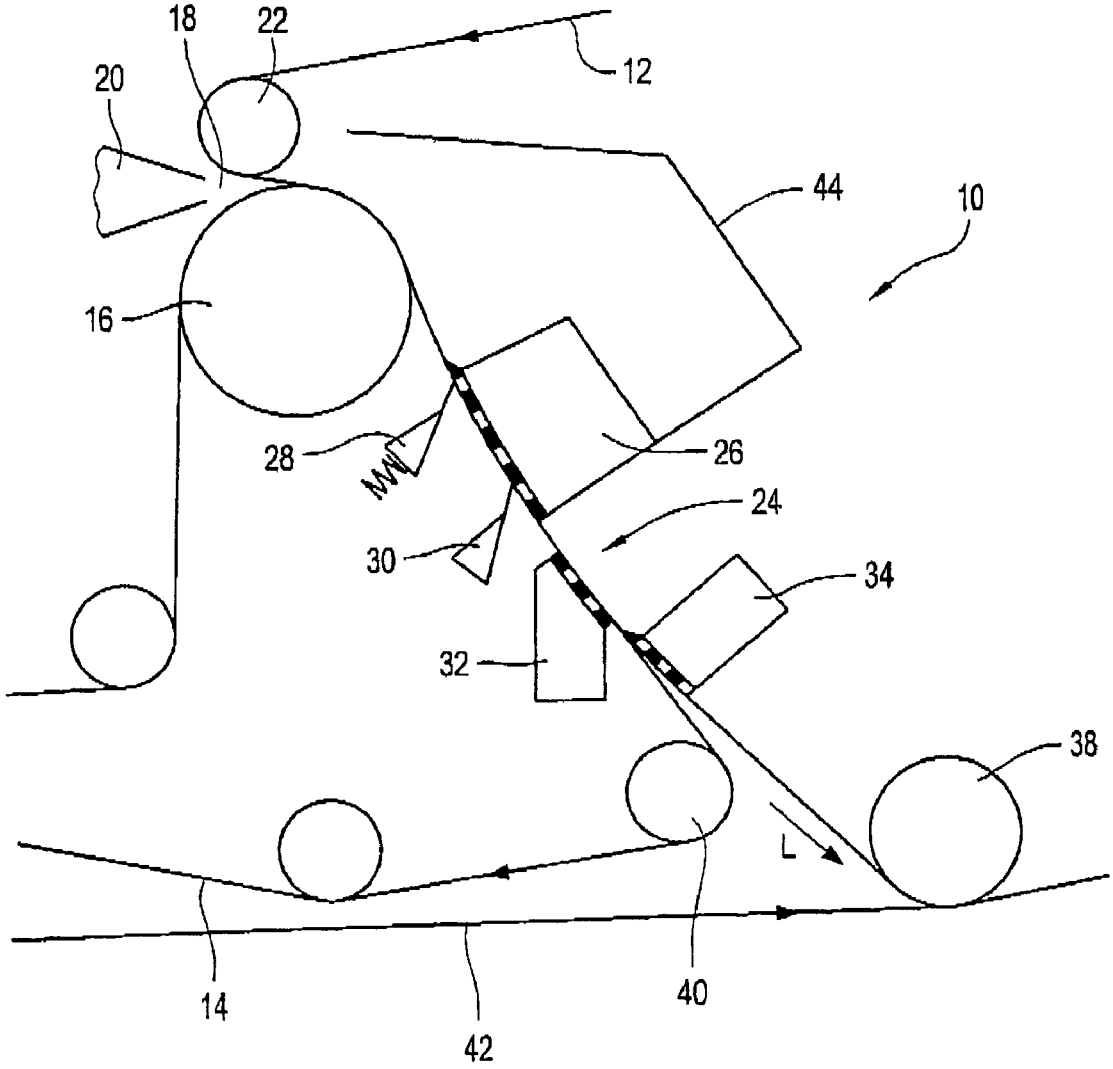
FIG. 2 is a schematic partial illustration of an additional embodiment of a wire section used in a twin wire former, whereby the fiber ply that is formed by the twin wire former is combined with a fiber ply that is delivered on a belt or similar device.

The arrangement illustrated in FIG. 2 distinguishes itself from that illustrated in FIG. 1 essentially in that the fiber web that was formed by the twin wire former 10 is combined with a fiber web that is delivered on a basic belt 42, or similar device, for the purpose of creating a multi-ply fiber web. For this purpose, the fiber plies are combined specifically in the area of a couch roll 38 which, in the present example, is located in the loop of the outer wire 12 of the twin wire former 10.

After the twin wire zone 24 the inner wire 14 that is separated from the outer wire 12 as well as from the respective fiber ply, is carried over a turning roller or idler roller 40.

For the remainder, this embodiment could at least essentially have the same configuration as that illustrated in FIG. 1. Corresponding components have accordingly been assigned corresponding identifications.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wire section in a machine for the production of a fiber web, comprising:

at least one twin wire former, including:

a revolving continuous inner wire and a revolving continuous outer wire that each include a loop and converge in the area of a first forming element;

a first strip element located opposite said first forming element and proximate to at least one of said inside inner wire and said outer wire; and at least one additional strip element located after said first forming element, viewed in direction of web travel, inside another of the loop of said outer wire and the loop of said inner wire, at least one said additional strip element including at least one suction element, said at least one suction element being an integral unit that is structured and arranged for providing a vacuum that increases in the direction of wire travel, at least one said suction element being a suction box, said suction box having an essentially flat surface.

2. A wire section in a machine for the production of a fiber web, comprising:

at least one twin wire former, including:

a revolving continuous inner wire and a revolving continuous outer wire that each include a loop and converge in the area of a first forming element;

a first strip element located opposite said first forming element and proximate to at least one of said inner wire and said outer wire;

at least one additional strip element located after said first forming element, viewed in direction of web travel, inside another of the loop of said outer wire and the loop of said inner wire, at least one said additional strip element including at least one suction element, said at least one suction element being an integral unit that is structured and arranged for providing a vacuum that increases in the direction of wire travel; and a basic belt positioned immediately downstream from said twin wire former for carrying the fiber web and an additional fiber ply.

3. The apparatus of claim 2, wherein the fiber web and the fiber ply are combined in the vicinity of a couch roll.

4. The apparatus of claim 1, wherein said couch roll is located inside the loop of said outer wire.

5. The apparatus of claim 2, wherein said inner wire is guided over a turning roll located after the twin wire zone.

6. A wire section in a machine for the production of a fiber web, comprising:

at least one twin wire former, including:

a revolving continuous inner wire and a revolving continuous outer wire that each include a loop and converge in the area of a first forming element;

a first strip element located opposite said first forming element and proximate to at least one of said inner wire and said outer wire;

at least one additional strip element located after said first forming element, viewed in direction of web travel, inside another of the loop of said outer wire and the loop of said inner wire, at least one said additional strip element including at least one suction element, said at least one suction element being an integral unit that is structured and arranged for providing a vacuum that increases in the direction of wire travel; and a suction box located along said outer wire on either the side of the twin wire zone facing away from said first forming element or the side of the twin wire zone facing toward said first forming element, said suction box being straight or having a straight progression.

7. A wire section in a machine for the production of a fiber web, comprising:

at least one twin wire former, including:

a revolving continuous inner wire and a revolving continuous outer wire that each include a loop and converge in the area of a first forming element;

a first strip element located opposite said first forming element and proximate to at least one of said inner wire and said outer wire;

at least one additional strip element located after said first forming element, viewed in direction of web travel, inside another of the loop of said outer wire and the loop of said inner wire, at least one said additional strip element including at least one suction element, said at least one suction element being an integral unit that is structured and arranged for providing a vacuum that increases in the direction of wire travel;

a suction box located along said outer wire on either the side of the twin wire zone facing away from said first forming element or the side of the twin wire zone facing toward said first forming element; and at least one strip element pressed against, or fitting closely against, said inner wire on the side of the twin wire zone facing away from said additional suction box.

8. The apparatus of claim 7, wherein at least one said strip can be aligned to said inner wire in a fixed or resilient position.

9. The apparatus of claim 8, wherein at least one said strip can be aligned by at least one of a mechanical, electro-mechanical, pneumatic, and hydraulic device.

10. The apparatus of claim 7, wherein at least one said strip is fixed in position.

11. The apparatus of claim 7, wherein one first said strip is located ahead of one second said strip viewed in the direction of wire travel; and the first said strip is adjustable in position toward said inner wire and the second said strip is fixed in position toward said inner wire, or vice versa.

12. A wire section in a machine for the production of a fiber web, comprising:

at least one twin wire former, including:

a revolving continuous inner wire and a revolving continuous outer wire that each include a loop and converge in the area of a first forming element;

a first strip element located opposite said first forming element and proximate to at least one of said inner wire and said outer wire;

at least one additional strip element located after said first forming element, viewed in direction of web travel, inside another of the loop of said outer wire and the loop of said inner wire, at least one said additional strip element including at least one suction element, said at least one suction element being an integral unit that is structured and arranged for providing a vacuum that increases in the direction of wire travel; and a first additional strip located on the side of the twin wire zone facing the said first forming element and offset relative to an additional forming element, viewed in the direction of wire travel.

13. The apparatus of claim 12, further comprising a second strip element located on the side of said twin wire zone facing said additional forming element and preferably offset from said first strip element viewed in said direction of wire travel.

* * * * *

UNITED STATES PATENT AND TRADEMARK OFFICE

CERTIFICATE OF CORRECTION

PATENT NO. : 7,008,511 B2
APPLICATION NO. : 10/316489
DATED : March 7, 2006
INVENTOR(S) : Haase et al.

It is certified that error appears in the above-identified patent and that said Letters Patent is hereby corrected as shown below:

TITLE PAGE

In column 2, under Item [56] References Cited, in U.S. Patent No. 5,387,320 after Jaakkola, please delete "162/203", and substitute therefore --162/301--; and In column 2, under Item [56] References Cited, in U.S. Patent No. 5,972,168 after Egelhof et al., please delete "162/340", and substitute therefore --162/203--.

COLUMN 5

In line 43, after "said" and before "inner", please delete "inside".

COLUMN 6

In line 12, please delete "1", and substitute therefore --3--.

Signed and Sealed this

Ninth Day of January, 2007

JON W. DUDAS
*Director of the United States Patent and Trademark Office*